United States Patent [19]

de Lallée et al.

[11] 4,395,976

[45] Aug. 2, 1983

[54] HEAT EXCHANGER

[75] Inventors: Jacques de Lallée, Meylan; Daniel Tollens, Sassenage, both of France

[73] Assignee: Commissariat a l'Energie Atomique, Paris, France

[21] Appl. No.: 203,949

[22] Filed: Nov. 4, 1980

[30] Foreign Application Priority Data

Nov. 26, 1979 [FR] France ..... 79 29052

[51] Int. Cl.[3] ..... F22B 1/02; F17C 7/02

[52] U.S. Cl. ..... 122/32; 62/52; 122/305; 122/318; 122/367 C; 122/367 PF; 165/142; 165/36; 122/34

[58] Field of Search ..... 165/142, 52; 122/318, 122/319, 320, 32, 28, 367 PF, 367 C, 34; 219/271, 273, 275, 276, 302, 325; 62/52, 53; 123/557

[56] References Cited

U.S. PATENT DOCUMENTS

| | | | |
|---|---|---|---|
| 350,769 | 10/1886 | Ragot et al. | 123/557 |
| 655,274 | 8/1900 | Ramsden | 122/367 PF X |
| 1,623,074 | 4/1927 | Tartrais | 123/557 |
| 1,950,806 | 3/1934 | Mathes | 123/557 |
| 2,925,329 | 2/1960 | Yost | 219/273 X |
| 3,305,600 | 2/1967 | Hopper et al. | 165/142 X |
| 3,644,707 | 2/1972 | Costello | 219/325 X |
| 3,735,810 | 5/1973 | Ostbo | 165/142 |
| 4,275,699 | 6/1981 | Troglin | 123/557 |

*Primary Examiner*—Albert W. Davis, Jr.

*Attorney, Agent, or Firm*—Pearne, Gordon, Sessions, McCoy, Granger & Tilberry

[57] ABSTRACT

Heat exchanger comprising a first enclosure in which heat is supplied, in thermal contact with at least one second enclosure at the top of which arrives a cold heat transfer fluid in the liquid state and at least one pipe, placed in the second enclosure, via which the fluid is discharged in the form of vapor or a liquid-vapor mixture, wherein the second enclosure incorporates a filling making it possible to regulate the outflow of fluid to the bottom of the second container and the partial transformation of said fluid into vapor which can escape by means of the pipe which, for this purpose, has holes arranged over its entire height.

3 Claims, 3 Drawing Figures

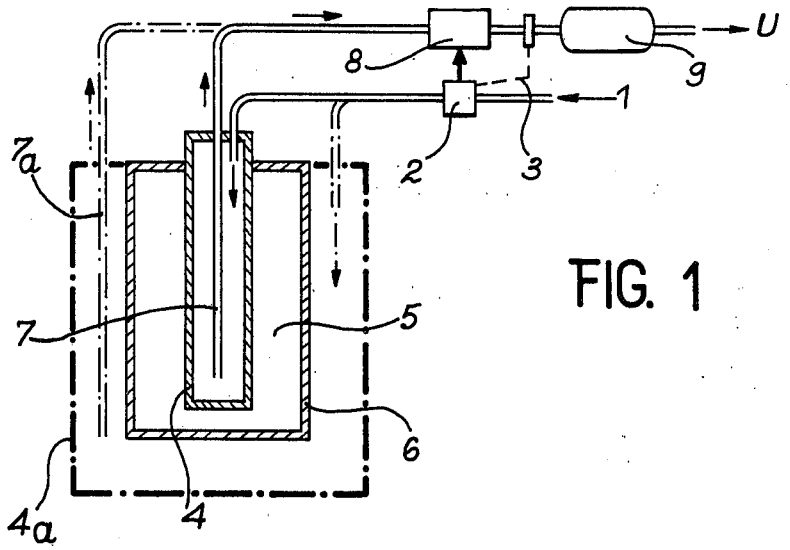
FIG. 1
FIG. 3
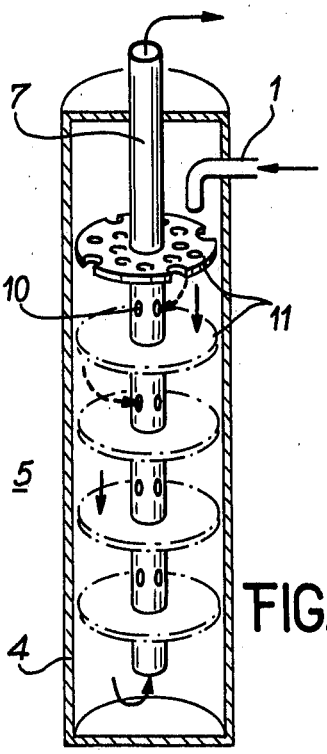
FIG. 2
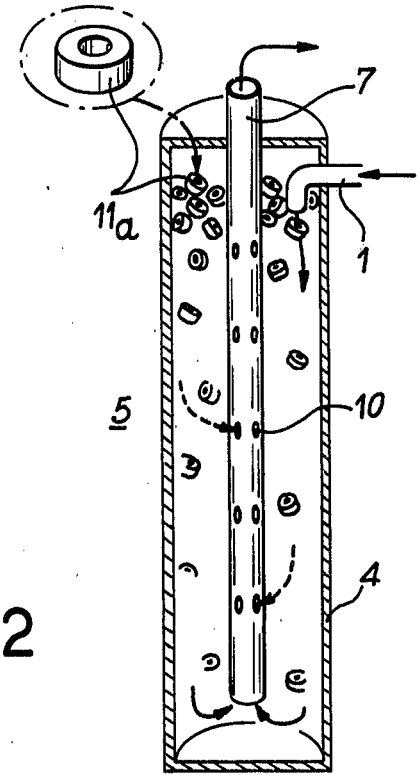

HEAT EXCHANGER

BACKGROUND OF THE INVENTION

The present invention relates to a heat exchanger.

As is known a heat exchanger is used for transmitting heat from one body to another via one or more metallic or non-metallic surfaces separating the two bodies simultaneously present in the exchanger. These heat exchange surfaces can in particular form one or more enclosures containing the body to be heated.

It is also known that the two thermally contacting bodies may or may not be fluids which may or may not undergo a change of state. In particular the hot body can be a pure body or a eutectic mixture in liquid form solidifying in contact with the hot body, giving off the stored heat in the form of latent heat. As a result of this heat exchange the cold body or heat transfer fluid may vaporize.

The present invention is applicable to the exchanger type, whose hot body is an autonomous heat source. These heat exchangers can be used for air conditioning, underwater air conditioning, solar storage, the recovery of heat, etc.

The known heat exchanger has a number of disadvantages in the case where the hot body is a material which is solidified during heat exchange and the cold body a fluid which vaporizes.

Thus, when the molten heat-storage material and the fluid come into contact via the heat exchange surfaces the material solidifies and suddenly gives off a large quantity of heat, which results in a rapid vaporization of the fluid and therefore causes a considerable increase in the gas pressure. In an irregular manner large vapour or steam bubbles then appear which momentarily obstruct the discharge pipe or pipes. As a result the evaporation operation conditions are unstable (sawtooth phenomenon).

In the special case of air conditioners for skin divers the enclosure or enclosures immersed in the heat-storage material are supplied by a fraction of the sea water flow, i.e. the heat transfer fluid used for heating a diving suit. The vapour emanating from it condenses in a mixer in an irregular manner. This leads to considerable variations in the flow rate of the heat transfer fluid and the temperature. This particular application does not make it possible to consider conventional methods for regulating the temperature and the heat transfer fluid flow, because the weight and overall dimensions of the heat exchanger are limited.

BRIEF SUMMARY OF THE INVENTION

The present invention relates to a heat exchanger which obviates these disadvantages and in particular makes it possible to regulate the flow and temperature of the heat transfer fluid by easily realizable means.

Thus, the invention relates to a heat exchanger comprising a first enclosure in which heat is supplied, in thermal contact with at least one second enclosure at the top of which arrives a cold heat transfer fluid in the liquid state and at least one pipe, placed in the second enclosure, via which the fluid is discharged in the form of vapour or a liquid-vapour mixture, therein the second enclosure incorporates a filling making it possible to regulate the outflow of fluid to the bottom of the second container and the partial transformation of said fluid into vapour which can escape by means of the pipe which, for this purpose, has holes arranged over its entire height.

According to another feature of the invention the filling of the second enclosure is formed by ceramic rings loosely stacked upon one another and in direct contact with the enclosure.

According to another feature of the invention the filling of the second enclosure is formed by metal plates, which are perforated, compatible with the heat transfer fluid, regularly spaced with respect to one another and integral with the pipe.

This autonomous heat exchanged can be used in any random position, which implies that the filling is fixed to a certain extent. This involves the complete filling of the second enclosure with ceramic rings or the welding of the perforated plates to the pipe.

According to another feature of the invention heat is supplied by means of a salt fused by the high latent fusion heat stored in the first enclosure.

In the present case the fused salt is a material with a high latent fusion heat chosen from among the fluorides, chlorides and hydroxides of alkali metals and alkaline earth metals and eutectic mixtures of said materials.

No matter whether the filling according to the invention is formed by perforated metal plates or ceramic rings the regular formation of vapour or steam instead of large vapour or steam bubbles is greatly facilitated. The formation of the vapour permits a better and rapid stabilization (roughly a few seconds instead of several minutes) of the temperature and flow rate of the heat transfer fluid. Moreover the surface in contact with the heat transfer fluid is sufficiently large to trap deposits transported in said fluid. In the special case of an exchanger for an autonomous air conditioner the heat transfer fluid used is sea water, which leads to rapid scaling of the different parts forming the exchanger. Therefore the heat exchanger must be rapidly dismantlable for complete cleaning purposes, which is the case here.

Throughout the remainder of the text embodiments will be described in which the second enclosure only has one secondary pipe, but it is obvious that the invention is not limited to this particular embodiment and also applies to the case where a number of secondary pipes are used in parallel.

BRIEF DESCRIPTION OF THE DRAWINGS

The invention is described in greater detail hereinafter relative to non-limitative embodiments and with reference to the attached drawings, wherein show:

FIG. 1—diagrammatically a heat exchanger for an air conditioner for a skin diver.

FIG. 2—diagrammatically part of the heat exchanger of FIG. 1 in which the enclosure filling is formed by perforated metal plates in accordance with a first embodiment of the invention.

FIG. 3—diagrammatically part of the heat exchanger of FIG. 1 in which the enclosure filling is formed by ceramic rings in accordance with a second embodiment of the invention.

DETAILED DESCRIPTION OF THE PREFERRED EMBODIMENTS

FIG. 1 shows a heat exchanger. Before entering the heat exchanger the heat transfer fluid arrives level with a three-way valve 2 by means of a pipe 1. Valve 2 is connected to a thermometer probe 3 making it possible to regulate the proportion of fluid to be heated and cold fluid over a period of time. The fluid portion to be heated enters the enclosures forming the heat exchanger. This enclosure can be central 4 and/or lateral 4*a*. This enclosure or enclosures is in direct contact with the heat storage material 5 placed in another enclosure 6. Enclosure or enclosures 4 and 4*a* respectively contain a pipe 7, 7*a* permitting the removal of the vapour formed. This vapour is transferred to a three-way mixer 8 at which also arrives the proportion of the heat transfer fluid which has not been heated. The outflowing heat transfer fluid enters a buffer storage tank 9 making it possible to regulate the directly usable heat transfer fluid flow.

FIG. 2 shows in a first embodiment an enclosure 4 of a heat exchanger in which circulates the fluid to be heated. This enclosure comprises a pipe 1 for introducing the fluid into the same and a filling which, in this first embodiment, is formed by perforated metal plates 11 welded to pipe 7 having small holes 10 over its entire length. This filling facilitates the transformation of the fluid into vapour which can escape via the holes 10 in pipe 7. This enclosure is also in direct contact with the heat-storage material 5.

FIG. 3 shows in a second embodiment the same heat exchanger enclosure 4. The parts which are common to FIG. 2 retain the same reference numerals and will not be described again. In this second embodiment the filling is formed by small ceramic rings 11*a* loosely stacked on one another, one of the rings being shown in detail so that its form is more apparent.

A general description of the operation of the heat exchanger will give a better understanding of the invention. The cold heat transfer fluid enters by pipe 1 into the thermostatically controlled three-way valve 2. Only part of the fluid is heated in the heat exchanger, whilst the other part is transferred to mixer 8. The cold fluid arrives level with the enclosure or enclosures 4 and 4*a* in thermal contact with the enclosure 6 containing the hot fused salt. On coming into contact with this heat source part of the fluid is transformed into vapour by means of the aforementioned filling. This vapour then escapes through the diametrically opposed holes in pipe 7. The non-vaporized fluid portion can easily flow by means of the filling to the bottom of the pipe, where it vapourizes and is discharged by said pipe. The thus heated fluid enters mixer 8 and then the buffer storage tank 9 making it possible to regulate the heat transfer fluid flow rate.

As a result of the filling formed from small metallic or non-metallic surfaces the heat exchanger according to the invention permits a rapid stabilization of the temperature and flow of the heat transfer fluid.

As the heat transfer fluid enters the exchanger and is heated the fused salt solidifies and cools. This leads to a reduction in the temperature of the heated heat transfer fluid over a period of time. To this end the thermostatically controlled valve 2 makes it possible to regulate the proportion of hot fluid and cold fluid and consequently the water flow rate to be used to obtain a constant temperature from the start to the finish of the operation.

In exemplified manner, tests have been carried out with cold water as the heat transfer fluid and with a eutectic mixture of lithium hydroxide and fluoride melting at 450° C. as the heat-storage material.

For a mass of 600 grammes of said mixture and a flow rate of the cold water at 15° C. of 60 l/h hot water at 50° C. has been obtained. This temperature rise of the water corresponds to an available power of 2.7 KW.

What is claimed is:

1. A heat exchanger comprising a first enclosure, in which heat is supplied, in thermal contact with at least one second enclosure at the top of which arrives a cold heat transfer fluid in the liquid state, and at least one pipe, placed in the second enclosure and ported at the top to the exterior of said enclosure, via which the fluid is discharged in the form of vapour or a liquid-vapour mixture, wherein the second enclosure incorporates a filling making it possible to regulate the flow of fluid to the bottom of the second container and the partial transformation of said fluid into vapour which can escape by means of the pipe which, for this purpose, has holes arranged over its entire height, said heat being supplied by means of a salt fused by the high latent fusion heat stored in the first enclosure.

2. A heat exchanger according to claim 1, wherein the filling of the second enclosure is formed by ceramic rings loosely stacked upon one another and in direct contact with the enclosure.

3. A heat exchanger according to claim 1, wherein the filling of the second enclosure is formed by metal plates, which are perforated, compatible with the heat transfer fluid, regularly spaced with respect to one another, and integral with the pipe.

* * * * *